US005344312A

United States Patent [19]

Polidero

[11] Patent Number: 5,344,312

[45] Date of Patent: Sep. 6, 1994

[54] ATMOSPHERIC GAS BURNERS OF THE HYPERSTOICHIOMETRIC MIXTURE TYPE

[75] Inventor: Nicco Polidero, Schio, Italy

[73] Assignee: Aldo Polidero, Schio, Italy

[21] Appl. No.: 51,164

[22] Filed: Apr. 22, 1993

[30] Foreign Application Priority Data

Apr. 28, 1992 [IT] Italy ..... VI92 A 000067

[51] Int. Cl.[5] ..... F23D 3/40

[52] U.S. Cl. ..... 431/326; 431/352

[58] Field of Search ..... 431/326, 350, 352

[56] References Cited

U.S. PATENT DOCUMENTS

| | | | |
|---|---|---|---|
| 4,156,591 | 5/1979 | Anderson | 431/354 |
| 5,133,657 | 7/1992 | Harris | 431/326 |
| 5,215,457 | 7/1993 | Sebastiani | 431/326 X |

*Primary Examiner*—Larry Jones

*Attorney, Agent, or Firm*—Bucknam and Archer

[57] ABSTRACT

An atmospheric gas burner, of the hyperstoichiometric mixture type, of a substantially tubular shape; wherein the mixture is discharged from a series of slots made in the top surface, these slots being arranged in one or more rows running parallel to the burner axis; wherein the width of these slots is such as to guarantee extremely low resistance to the passage of the comburent air/combustible gas mixture.

4 Claims, 1 Drawing Sheet

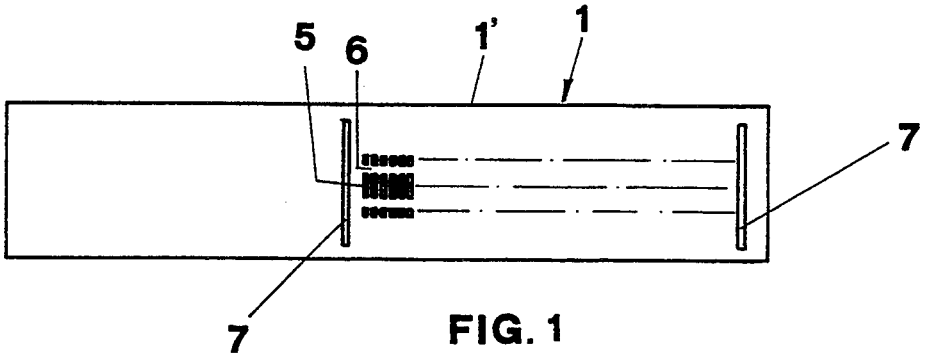
FIG. 1
FIG. 2
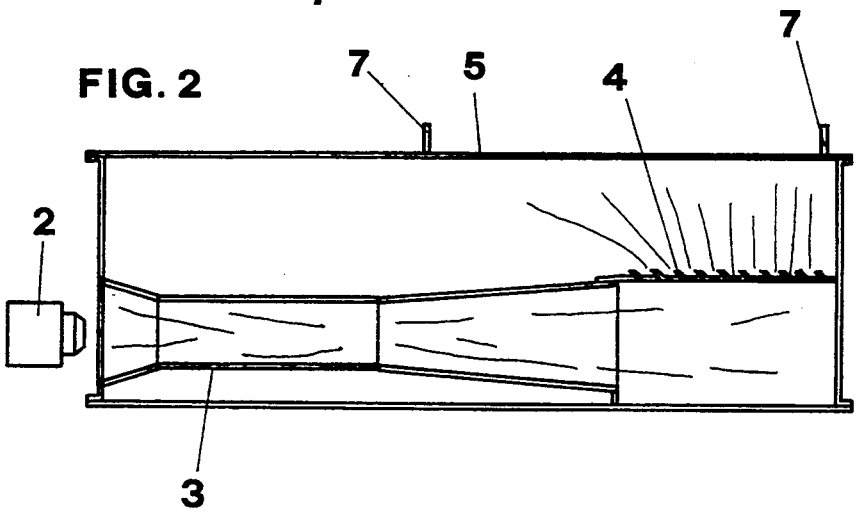
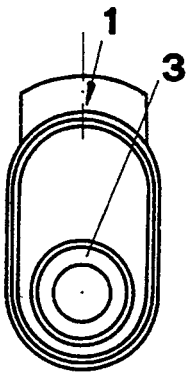
FIG. 3
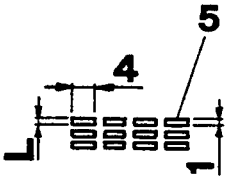
FIG. 4
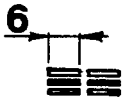
FIG. 7
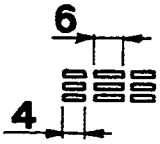
FIG. 5
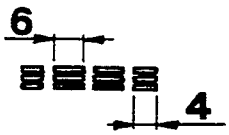
FIG. 8
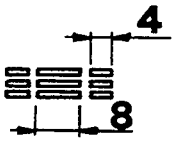
FIG. 6
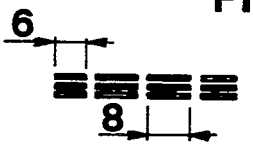
FIG. 9

ATMOSPHERIC GAS BURNERS OF THE HYPERSTOICHIOMETRIC MIXTURE TYPE

BACKGROUND OF THE INVENTION

1. Field of the Invention

The present invention concerns atmospheric gas burners, of the hyperstoichiometric mixture type of a substantially tubular shape, in which it is arranged that the mixture discharges from a series of slots made in the top surface of the burner body, these slots being arranged in one or more rows, which run parallel to the burner axis.

2. Description of the Prior Art

Burners have been known for some time which operate by hyperstoichiometric combustion; some of these burners moreover have provision for surface cooling, for example by means of the boiler water, all with the main aim of reducing the $NO_x$ content in the combustion products.

Burners of such a type are described, for example, in Italian patents nos, 1,191,596 and 1, 214,314 in the same name as the present applicant.

The utilisation of cooling water, generally taken from the boiler circuit, allows the burners optimum possibilities of use, by utilising all the gases available in the distribution system, in particular permitting them to function even in the presence of extremely low pressures in the aforesaid systems.

In fact until quite recently the occurrence of even sudden pressure drops was not rare.

Nowadays distribution controls are much improved and one can be reasonably certain of being able to count on pressures at the injector of 120–140 mm water column, at least as regards natural gas.

This allows, on the one hand, for a pressure to be arranged, sufficient in every case to obtain the hyperstoichiometric mixture without having to resort to special measures and, on the other, of being able to vary the pressure, for example, from 100 to 140 mm, thus allowing a certain modulation of the load.

SUMMARY OF THE INVENTION

An object of the present invention is to enable the provision of a burner capable of operating with hyperstoichiometric combustion, which is capable of supplying good results with regard to $NO_x$ emission.

According to the invention there is provided an atmospheric gas burner of the hyperstoichiometric type, substantially tubular in shape, in which it is provided that the mixture is discharged from a series of slots made in a surface corresponding to the top part of the said burner, these slots being arranged in one or more rows which run parallel to the axis of the burner, wherein the width of the slots is such as to provide extremely low resistance to the passage of the comburent air/combustible gas mixture.

BRIEF DESCRIPTION OF THE DRAWINGS

Thus the object of the invention may be achieved by arranging the said burner and in particular the slots provided in it via which the combustible air-gas mixture is discharged, according to the method which is described below by way of example with reference to the accompanying drawings wherein:

FIGS. 1, 2 and 3 represent three views of one particular design of burner according to the invention, these being respectively a plan view, a longitudinal section and a side elevation; and FIGS. 4 to 9 each represent a possible configuration of the slots shown on the burner according to the invention.

DESCRIPTION OF THE PREFERRED EMBODIMENT

In FIGS. 1 to 3 it may be seen that the invention concerns a burner 1 which is substantially tubular in shape. The combustible gas enters via a nozzle 2 and is mixed with the comburent air inside a venturi pipe 3, arranged on the inside of the external surface 1 of the burner; in that surface a series of slots 5 have been made, arranged in parallel in one or more rows which run parallel to the burner axis.

The mixture is caused to flow to the slots, in relation to which combustion occurs, after passing into a distributor 4, at the outlet from the venturi pipe 3.

The fundamental characteristics of the invention as illustrated reside in the special shape of the slots 5. In the first place the width of the above is such as to provide extremely low resistance to the passage of the combustible air-gas mixture.

Advantageously, such width will be substantially equal to 1 mm.

Moreover the slots are arranged not in one but indeed in a series of rows, between which there is a solid area 6, which is capable of stabilising the flame.

Tests carried out have furthermore shown that preferably the slots of a single row are mutually equidistant.

In addition, the improved results are obtained at a pressure at that nozzle varying from 100–140 mm of water column.

In FIGS. 4 to 9 the numerals (with the exception of reference numeral 5 which designates the slots), indicate in millimeters possible dimensions of the slots; as can be seen, and preferably, the slots placed in a lateral position will be of a shorter length compared to those placed centrally, so as to avoid as far as possible the phenomenon of decollating flames.

Advantageously, in addition, two thin plates (not shown) are provided which extend perpendicularly from the external surface of the burner and which are normally arranged in relation to the axis of the burner, at the start and at the end of the rows of slots from which the flame emerges; these thin plates protect the beginning and the end of the flame from excessive dilution caused by secondary air and increase its stability.

Tests carried out have furthermore permitted verification that the use of slots of a width equal to approx. 1 mm does not increase the danger of a flash-back, from the moment that the burner operates in hyperstoichiometric condition; in fact the unsupported flame does not heat up the surface and the hyperstoichiometric mixture has a fairly low flame propagation velocity.

In addition, it has been possible to ascertain that the $NO_x$ content in the combustion products always remains very low. Finally, the particular shape of the slots described above allows the burner to change over without any problem from functioning with "H" designated type of natural gas (pure methane) to "L" designated type of natural gas (containing nitrogen), without any particular disadvantages such as the possibility of excessive disjunction of the flames or of excessive emissions of carbon monoxide. This proves particularly advantageous in places where possibly the supply of natural gas is changed from type "H" to type "L" without any prior warning.

I claim:

1. An atmospheric gas burner of the hyperstoichiometric type wherein the burner is fed with natural gas at a pressure in the range of 100 to 140 mm of water column, said burner being substantially tubular in shape and the mixture discharged from a series of slots formed in a top surface of said burner, and slots being arranged in one or more continuous and uninterrupted rows arranged parallel to an axis of said burner, wherein the width of the slots is substantially 1 mm so as to provide extremely low resistance to the passage of the comburent air/combustible gas mixture.

2. A burner, according to claim 1, including a series of rows of slots mutually separated by a solid area without any slots, capable of stabilising the flame.

3. A burner, according to claim 1 wherein the slots of a single row are mutually equi-distant.

4. A burner, according to claim 1 including two thin plates issuing perpendicularly in relation to the external surface, which are normally arranged in relation to the axis of the burner, at the start and at the end of the rows of slots from which the flame emerges.

* * * * *